United States Patent [19]

Schmitzer et al.

[11] Patent Number: 5,072,404

[45] Date of Patent: Dec. 10, 1991

[54] METHOD OF TRACKING FLUIDS FLOWING ALONG A FLOW PATH

[75] Inventors: James L. Schmitzer; Dennis M. Simmonds; Kevin B. Hicks, all of Duncan, Okla.

[73] Assignee: Halliburton Company, Duncan, Okla.

[21] Appl. No.: 567,869

[22] Filed: Aug. 14, 1990

[51] Int. Cl.[5] ..... E21B 47/00; G01F 13/00

[52] U.S. Cl. ..... 364/510; 364/578; 364/422; 364/149; 73/155

[58] Field of Search ..... 364/558, 578, 510, 509, 364/506, 422, 149; 166/285; 73/155, 53

[56] References Cited

U.S. PATENT DOCUMENTS

| | | | |
|---|---|---|---|
| 4,571,993 | 2/1986 | St. Onge | 73/151 |
| 4,654,802 | 3/1987 | Davis | 364/502 |
| 4,677,587 | 6/1987 | Zemany, Jr. | 364/900 |
| 4,726,219 | 2/1988 | Pearson et al. | 73/53 |
| 4,747,060 | 5/1988 | Sears, III et al. | 364/481 |
| 4,754,641 | 7/1988 | Orban et al. | 73/155 |

OTHER PUBLICATIONS

Publication SPE 13045 entitled "The Phenomenon of Free Fall During Primary Cementing" by R. M. Beirute, (1984).

Publication entitled "Mathematical Algorithm Aids Analysis of 'U-Tubing' During Slurry Placement" by M. Wahlmeier and S. Lam, Oil & Gas Journal, (Jan. 7, 1985).

Publication SPE 16649 entitled "A Technique for On-site Diagnosis of Cement Job Problems: The Concept of Job Signatures" by R. M. Beirute, (1987).

SPE 15519 entitled "Techniques for Planning and Execution To Improve Foam Cement Job Performance", by D. S. Kulakofsky and P. G. Creel, Halliburton Services and D. L. Kellum, Parker & Parsley, (12/1986).

Pages 237-244 of "Programming Concepts and Problem Solving an Introduction to Computer Science Using Pascal", by Peter Linz (12/1983).

Pages 155-160 of "Programming Concepts and Problem Solving an Introduction to Computer Science Using Pascal", by Peter Linz (12/1983).

*Primary Examiner*—Parshotam S. Lall

*Assistant Examiner*—S. A. Melnick

*Attorney, Agent, or Firm*—James R. Duzan; E. Harrison Gilbert, III

[57] ABSTRACT

A method of tracking fluids flowing along a flow path is disclosed. A flow path is initially described corresponding to the flow path geometry which can be subdivided in real time to correspond to actual fluid volumes which are moved through the flow path. A recursive operation is used to account for moved volumes which exceed segment volumes during one tracking time period. An improved definition of a curved flow path segment is also disclosed. The disclosed method also pertains to maintaining a well pressure balanced by compensating for free fall.

11 Claims, 4 Drawing Sheets

Microfiche Appendix Included
(3 Microfiche, 114 Pages)

METHOD OF TRACKING FLUIDS FLOWING ALONG A FLOW PATH

MICROFICHE APPENDIX

A microfiche appendix (three sheets containing 114 frames) is incorporated herein. Sheets 1, 2 and 3 of microfiche appendix include an Appendix 1, and Appendix 2 and an Appendix 3, respectively.

BACKGROUND OF THE INVENTION

This invention relates generally to methods of tracking fluids flowing along a flow path. In a particular aspect, the present invention relates to a method of tracking fluids flowing in a tubing located in a well and in an annulus defined outside the tubing. In another aspect, the invention relates particularly to a method of maintaining a well pressure balanced with respect to the fluids flowing through the tubing and annulus.

When a fluid is conducted along a flow path, characteristics of the fluid sometimes need to be known to determine whether the flow is occurring as planned. This is particularly true for a flow containing different fluids conducted in series, such as during the cementing of tubular casing in the bore hole of an oil or gas well. For example, an equivalent circulating density is one characteristic used to monitor an oil or gas well cementing operation.

To cement casing in a well bore, spacers, cement slurries and other single or multiple phase fluids are pumped into the casing on top of drilling fluid which was previously placed in the well. These added fluids force the previously placed and added fluids down through the casing and up through the annulus between the casing and the well bore, expelling fluid at the top of the annulus. If the weight of the added trailing fluid exceeds the weight of the leading fluid or fluids, a "free fall" condition results.

During the normal course of a cementing operation, it is desirable to keep track of where the different types of fluids are along the flow path which includes the casing and annulus. Dynamic characteristics of these fluids during flow should also be tracked or monitored to insure that the flow is occurring as desired (for example, to insure that a cement slurry is not setting up too fast). It is also desirable to keep track of the flowing fluids to determine when free fall occurs so that a pressure balancing compensation can be made at the inlet to stop the free fall and regain control of the operation.

A type of computer-implemented method has been previously used to monitor fluid flow in a cementing operation. This has included dividing the casing and annulus flow path into segments wherein each segment has a known geometry. These segments are defined by data stored in fixed arrays within the memory of the computer. These arrays have a fixed size which limits the number of segments into which the flow path can be divided. In practice, this has prevented dynamic changes from being made as the monitored flow actually occurs. This has resulted in a lack of precision in the calculated characteristics of the fluids.

The free fall phenomenon and a type of method of trying to compensate for it are likewise known; however, this has focused on monitoring inlet pressure or other aspects of the flow which we believe produce a less precise indication of free fall.

Although there are already methods related to tracking flowing fluids and free fall, there is the need for a method which gives more flexibility in tracking fluids throughout the actual time the flow is occurring so that better, more precise information can be obtained about the tracked fluids. There is particularly the need for a method adapted to track fluids through various segments within a tubing and annulus during a cementing job. This method should also be adapted for accommodating curved segments which exist in deviated wells. There is also the need for a method particularly adapted to track fluids for maintaining a pressure balance to overcome free fall tendencies such as can occur in a vertical well in which a cement slurry is pumped in on top of one or more lighter fluids.

SUMMARY OF THE INVENTION

The present invention overcomes the above-noted and other shortcomings of the prior art by providing a novel and improved method of tracking fluids flowing along a flow path. The present invention gives more flexibility in tracking fluids than is available from existing methodologies of which we are aware. The present invention is particularly adapted for tracking fluids flowing through tubular casing and an annulus during a cementing job in an oil or gas well even where the well is deviated so that there are curved sections within the flow path. In another aspect, the present invention is particularly adapted for tracking fluids and determining when a free fall condition occurs and for determining a countering or offsetting inlet flow to maintain pressure balance in the flow path.

The present invention provides a method of tracking fluids flowing along a flow path, comprising the steps of: (a) selecting a plurality of segments to characterize the flow path, including defining a geometry for each segment; (b) identifying any previously placed fluid within the flow path and identifying any additional fluid to be moved into the flow path; (c) moving previously placed fluid and additional fluid along the flow path at a known rate of movement; and (d) at selected times while the fluids move along the flow path, calculating parameters of the fluid. When the volume of fluid which has been moved during a particular tracking time period is less than volumes of the defined segments of the flow path, the method includes dynamically allocating nodes within the segments so that each node contains only one of the fluids, and calculating parameters of the fluid within each node based on the defined geometry and identified fluids of steps (a) and (b), above. When the volume of moved fluid exceeds the volume of a segment, the method includes calculating, at the later of two consecutive times defining the tracking period, parameters for the total volume of the fluid moved relative to the exceeded segment during the time between the two consecutive selected times In a preferred embodiment of the method applicable to tracking fluids in a deviated well wherein the flow path includes a curved section having a length L and having two ends curving from respective references at angles $\theta_1$ and $\theta_2$, respectively, the step of defining a geometry as recited in step (a) includes defining for the curved section a straightened length defined by $\sin|\theta_2-\theta_1|/|\theta_2-\theta_1|\times Pi/180\times L/\cos(|\theta_2-\theta_1|/2)\times\sin(90-|\theta_2-\theta_1|/2-\theta_1)$.

The present invention also provides a method of maintaining a well pressure balanced, which well includes a tubing and an annulus through which fluid flows. The method comprises the steps of: flowing fluid through a selected one of the tubing and annulus into the other of the tubing and annulus so that there are three regions of flow, including: in the tubing, between the tubing and annulus, and in the annulus; converting within a computer the actual geometries of the three regions into equivalent geometries; computing within a computer equivalent densities of the fluid within the tubing and annulus; calculating, using the equivalent geometries and densities, a needed fluid flow between the tubing and annulus to balance the well pressure; determining the actual input flow for the actual geometries and densities; and adding vacuum into the selected one of the tubing and annulus at the calculated actual input flow.

Therefore, from the foregoing, it is a general object of the present invention to provide a novel and improved method of tracking fluids flowing along a flow path. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENT

Figure 1:
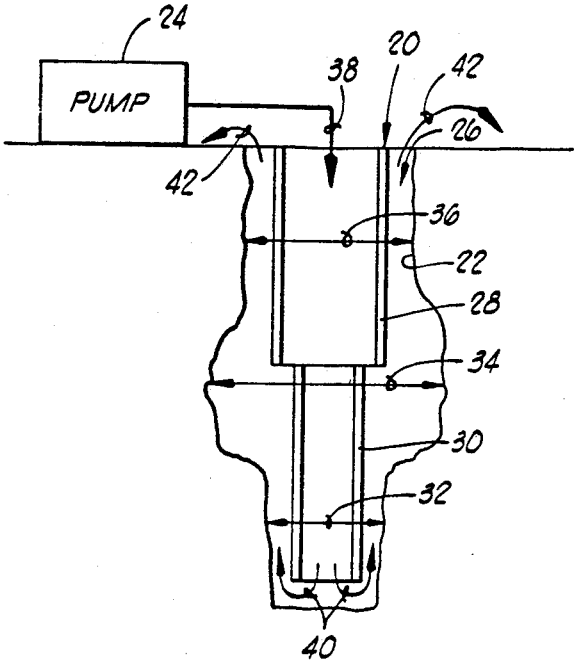
FIG. 1 is a schematic illustration of a casing in a well bore, which casing is to be cemented into the well bore.

The present invention can be used to track different types of fluids along different types of flow paths; however, the preferred embodiment will be described with reference to tracking fluids used during a cementing operation in a well. A simplified illustration of a well is shown in FIG. 1. A tubing 20 is to be cemented into a well bore 22 by pumping a cement slurry from a pump 24 through the tubing 20 and up an annulus 26 defined outside the tubing 20 between the tubing 20 and the well bore 22.

In the illustrated example, the tubing 20 includes two different diameter casings 28, 30. The well bore 22 also has different diameters as indicated by diameter lines 32, 34, 36.

When the tubular casing is hung in the well bore 22 before it has been cemented, there is typically other fluid, such as drilling mud or other previously placed fluid, in the well. To cement the casing, the fluids used during the cementing operation are pumped by the pump 24 into the internal channel of the upper casing 28 on top of the previously placed fluid. These pumped fluids are typically single or multiple phase fluids of types as known in the art. These fluids are pumped in series. For example, a spacer is first pumped on top of the previously placed drilling mud in the well, and then a cement slurry is pumped on top of or behind the spacer. As pumping occurs, fluid flow occurs through the three main sections of the illustrated flow path, namely, through the tubing 20, around the lower end of the tubing, and up the annulus 26. If needed, fluid can be expelled from the annulus 26. This flow path is indicated by arrows 38, 40, 42 in FIG. 1.

Figure 2:
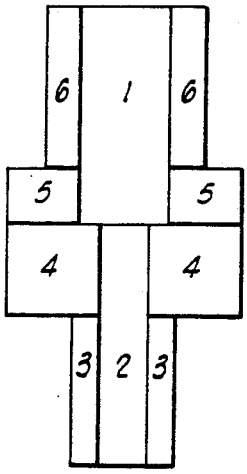
FIG. 2 is a block diagram showing the flow path of the structure in FIG. 1 defined in terms of segments wherein each segment has a known geometry.

To track the fluids flowing through this flow path, the tubing 20 and the annulus 26 are defined as a series of contiguous segments wherein each segment has a known geometry. For simplicity, the geometry is preferably made uniform (e.g., constant diameter throughout the length). This does not mean that each segment necessarily has the same geometry as every other segment, but rather that within each segment there is a uniform geometry. Thus, the flow path is characterized by a plurality of selected segments, which selection is made in a preferred embodiment based on a substantially uniform geometry within the actual flow path. In the preferred embodiment the actual geometry considered includes the inner and outer diameters of the sections of the tubing 20 and the different diameters of the well bore 22 in relation to the outer diameters of the tubing 20. The flow path of FIG. 1, extending through the two different diameter casings 28, 30 and the annulus defined between the casings 28, 30 and the three different diameter sections of the well bore 22, can be defined by six contiguous segments numbered 1 through 6 as illustrated in FIG. 2. These can be determined in a known manner, such as by knowing the type of casing which has been put in the well bore and by known logging techniques which log the geometry of the well bore 22.

Figure 3:
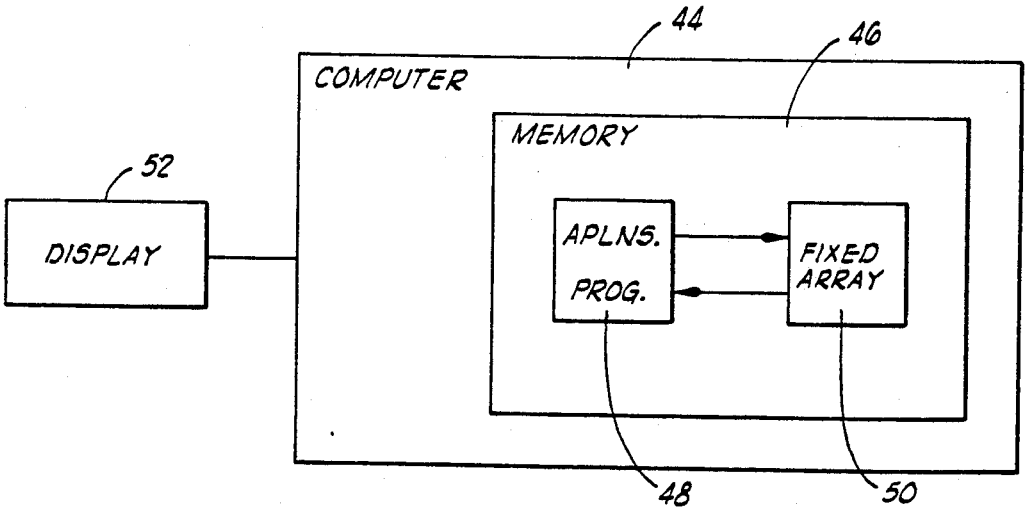
FIG. 3 PRIOR ART
FIG. 3 is a block diagram of a prior art system using the prior art fixed array method of tracking fluids.
Figure 4:
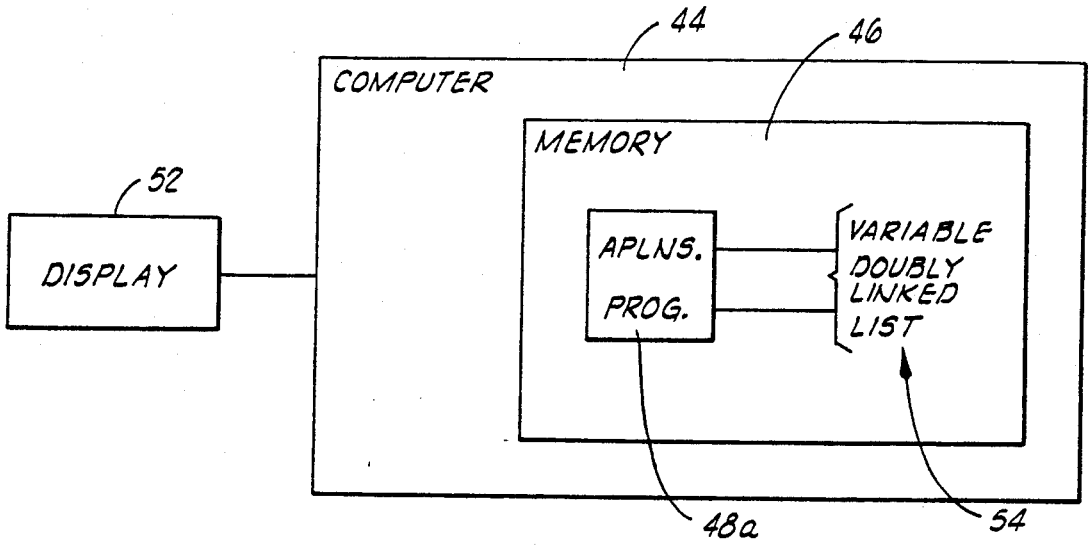
FIG. 4 is a block diagram comparable to FIG. 3 but utilizing the variable doubly linked list methodology of the present invention.

This type of segmentation of the flow path has been used in the prior art method for tracking fluid of which we are aware. This prior art method has, however, been limited to some maximum number of such segments (typically 30 in the type of which we are aware). This limitation exists because the prior art method uses a "fixed array." In tracking fluids, the prior art method has used a conventional computer 44 having a conventional memory 46 as represented in FIG. 3. Stored within the memory 46 is an applications program 48 which stores and retrieves data about the segments of the flow path from a fixed array 50. The fixed array 50 is a specifically defined section of the memory 46. This section of the memory cannot be expanded during the running of the applications program 48 so that the applications program 48 is limited to a maximum number of sets of data which can be stored in the fixed array 50, each of which sets of data corresponds to a respective one of the segments of the segmentized flow path. Although this type of method produces calculated outputs of the same characteristics which the present invention produces, and which outputs are displayed to a human operator through a conventional display terminal 52, there is an inherent limitation on the precision with which the prior art method can perform the calculations due to the limitations imposed by the fixed array 50.

The present invention can be implemented by using the same fixed segments which are initially selected as shown in FIG. 2 and by using the same computer 44, memory 46 and display 52. To a certain extent, the present invention can even use the same applications program 48 in that the present invention outputs the same calculated characteristics of the tracked fluids; however, the applications program 48*a* of the present invention is distinct from the prior art because the program 48*a* uses variable doubly linked sets of data 54 which can be changed as desired during real time tracking of the fluids. That is, the sets of data 54 may initially be preset with the same data a has been used in the fixed array 50 of the prior art; however, the variable doubly linked list 54 is dynamically changed during the running of the applications program 48*a* to add additional sets of data without the limitations inherent in the static fixed array 50.

Figure 5:
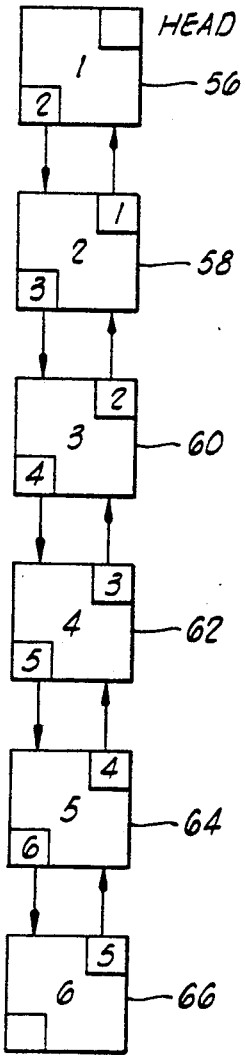
FIG. 5 is a block diagram depicting doubly linked sets of data contained in the memory of the FIG. 4 illustration, which sets of data correspond to the six-segment flow path illustrated in FIG. 2.

In the present invention, the respective sets of data defining the segments are entered into the computer 44 in doubly linked format. These sets of data include the uniform geometries of the respective segments This places in the computer 44 the sets of data so that each set is doubly linked to the respective sets of data for any contiguous segments. The doubly linked sets of data for the six segments depicted in FIG. 3 are represented in FIG. 5. Pointers are associated with each respective set to point to, and thereby link with, the sets of data for contiguous segments. Thus, for segment 1 of FIG. 2, there is a set of data 56 having a pointer linking it with a set of data 58 for the segment 2. A double link is established by the return pointer from set 58 linking to set 56. As shown in FIG. 5, double links are similarly established for the remaining sets of data 60 (for segment 3), 62 (for segment 4), 64 (for segment 5), 66 (for segment 6). These doubly linked sets of data may be referred to as nodes. Each node has a associated geometry number corresponding to the segment number shown in FIG. 2 because each segment number is an indication of the present well geometry. Using the nodes and the double links allows for dynamic allocation of fluids among the segments during real time flow of the fluids as will be further described hereinbelow.

In addition to setting up a doubly linked list of data defining the segments, a table of fluids is also set up. This table includes characteristics of the fluids already in the well and those to be added. The previous fluids and the fluids to be added are identified by their rheology (e.g., n', k', plastic viscosity, yield point and density) and the pump rates and foam rates. The information entered in the table of fluids is based on the actual fluids in the well and on fluids as planned to be added based on the prepared plan for the particular job. Such prepared plan is developed in a manner as known in the art.

With regards to the initially defined segments and their respective sets of data, a respective set of data also includes an identification of any previous fluid already in the well in the portion of the flow path to which the respective set of data corresponds.

Figure 6:
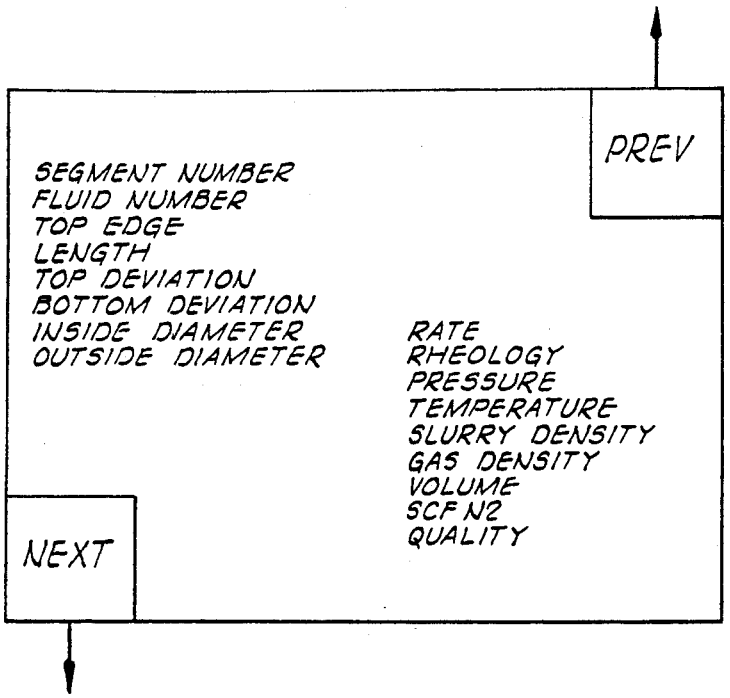
FIG. 6 is a block diagram including a list of information contained in or calculated for each set of data in the variable doubly linked list of a preferred embodiment of the present invention

In addition to containing the identification of the type of fluid in the segment, which is done by simply assigning a fluid number to each fluid in the table of fluids and entering that same number into the sets of data for those segments where that particular fluid is located, each set of data for a segment may include the information listed in the left-hand column of the data set represented in FIG. 6. This information includes the geometry number which has been assigned (i.e., 1, 2, 3, 4, 5 or 6 for the configuration illustrated in FIG. 2) and the geometrical parameters designating where the top edge of the segment is within the well, what the length of the segment is and what the inside and outside diameters of the segment are. FIG. 6 also shows that top and bottom deviations are entered. These deviations pertain to nonvertical segments such as curved segments in a deviated well. These deviations are the respective angles from vertical and horizontal of the top and bottom ends, respectively, of the curved segment.

With the doubly linked list of initial nodes and the table of fluids set up in the computer, the pumping of the additional fluids begins. This moves the previous fluids and additional fluids along the flow path at a known flow rate. Referring to the environment shown in FIG. 1, as fluid is pumped into the mouth of the casing 28 at the well head as indicated by the arrow 38, the fluid ahead of what is being added is displaced down the casing, around the end of the lower casing 30 as indicated by the arrows 40, and up the annulus 26. If this flow path was previously full, fluid flows out of the annulus 26 at the mouth of the well as indicated by the arrows 42 in FIG. 1. For simplicity of explanation, fluid flow or loss into the formation around the annulus 26 will be disregarded.

While the fluid is flowing, the computer 44 is operating. At selected times during this flow, the computer calculates parameters of the fluids based on the defined geometries and the identified fluids for each set of data corresponding to each segment. The computer repetitively determines the various parameters of the fluids at each selected time, such as every one second in the preferred embodiment.

Figure 7:
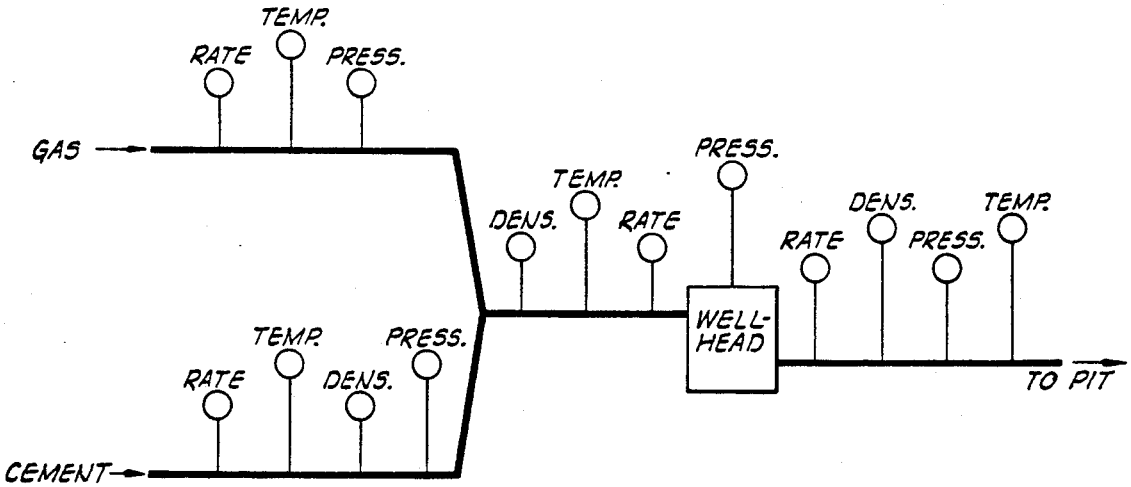
FIG. 7 is an illustration of a surface equipment configuration through which cement slurries and other fluids are moved into and out of a well and by which conditions are measured.

Referring to the right hand column within the FIG. 6 representation of one set of data, the parameters or characteristics calculated in the preferred embodiment include flow rate, rheology, pressure, temperature, density, volume, and quality. Another calculated value is standard cubic feet of nitrogen. The computer uses these parameters with the defined geometry of the respective segment to determine the friction loss and volume change of the fluids. These are dynamically calculated during fluid flow as has been done in the prior art method using the fixed array; however, the present invention gives a more precise representation of the flowing fluids. The engineering formulas used to make the calculations are known and are based on constant mass (i.e., for single phase flow, the volume into a segment must equal the volume out of the segment). At least some of these calculations require measured information such as actual flow rates, temperatures, pressures and densities. These can be obtained in conventional manners with conventional equipment as is well known in the art. An illustration of a surface equipment configuration by which cement slurries and fluids are conducted into and out of a well head and by which such information can be obtained is shown in FIG. 7.

Under the assumption that volume in equals volume out, it is assumed that fluids already in the well are shifted along the flow path by the same volume as is added by the pumping during the time interval between two consecutive calculations. That is, in the preferred embodiment wherein the fluids are tracked every one second, a known volume of added fluid is input into the flow path based upon the known pump rate and the one second time interval. It is then assumed that the fluids already in the well are moved by this same volume. Thus, this volumetric shift will be equal to, less than or greater than the respective volumes of the defined segments exemplified in FIG. 2 as represented by the nodes of the doubly linked list of FIG. 5.

For a segment having a volume which is the same as the volume of a single fluid moved relative thereto, no change in the definition of the corresponding node is needed. For example, if segment 1 was defined with a volume of ten gallons and ten gallons of a single type of fluid are pumped into the segment during the tracking interval, the original definition of segment 1 contained in node 1 of FIG. 5 will be used in making the calculations for the ten gallons of fluid which have just been pumped into the actual section of the casing 28 corresponding to segment 1.

Figure 8:
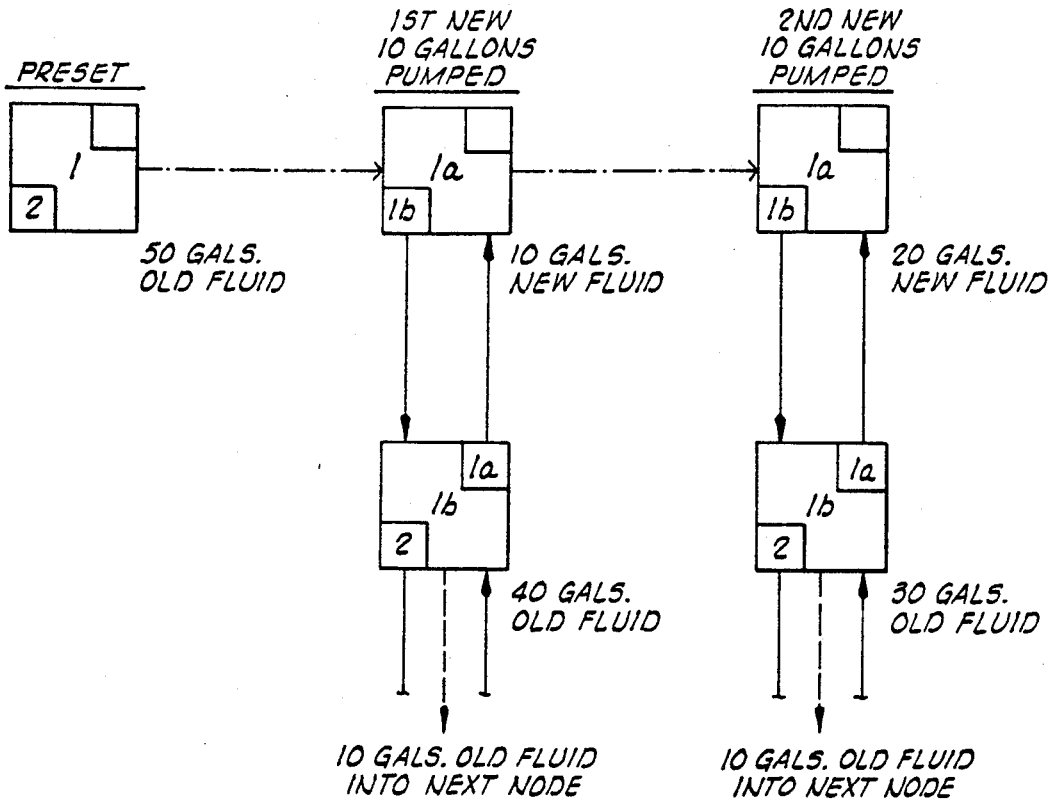
FIG. 8 is a block diagram to illustrate how the doubly linked list of FIG. 5 is dynamically changed while tracking fluid flow through the flow path defined in FIG. 2.

If the fluid pumped during the tracking interval is less than the respective segment volume, the segment is in effect divided into subsegments. This is implemented in the computer by adding nodes for the same respective geometry number wherein each node of the geometry member has a volume corresponding to the volume of a respective type of fluid within the segment to which the geometry number and nodes pertain. Referring to FIG. 8, it will be assumed that segment 1 was originally defined to have a volume of fifty gallons containing an "old" (i.e., previously placed) single phase fluid. Assume that during the one second tracking interval, only ten gallons of a new single phase fluid are pumped. This means that ten gallons of the old fluid previously in segment 1 must be moved out of segment into segment 2 and ten gallons of the newly pumped fluid added into segment 1. Since the old fluid previously in segment 1 and the newly pumped fluid are different types of fluids, there are now two different types of fluid in segment 1. Because the parameter calculations are made for only one type of fluid at a time, segment 1 needs to be divided within the computer into two nodes 1*a*, 1*b* and doubly linked within the original list illustrated in FIG. 5. As illustrated in FIG. 8, node la is defined as a ten gallon node and node 1*b* is defined as a forty gallon node. Each node is defined so that it contains only one type of fluid. Having redefined segment 1 in real time during the time the fluid is actually flowing, the computer 44 then calculates the parameters of the fluid within each node based on the defined geometry and the identified fluids. Thus, this creates within the computer, at a selected time while pumping occurs and in response to the known flow rate, additional sets of data, or nodes within the doubly linked list, corresponding to in effect subdivisions of the originally defined segments. Each of these new sets of data is inserted in the proper place within the doubly linked list of all the sets of data FIG. 8 also illustrates the process at a second time. This process is repeated at one second intervals in the preferred embodiment For the second interval illustrated in FIG. 8, the volumes in node 1*a* and node 1*b* have been redefined because, after another ten gallons of the new fluid have been pumped into the well, twenty gallons of the new fluid are now at the top of original segment 1 and thirty gallons of the previous fluid are now at the bottom of the segment 1. The two redefined nodes correspond to these then current volumes of the respective fluids. Calculations are then performed for these respective volumes.

The foregoing steps of subdividing into additional nodes and performing calculations occur as needed for each original segment and for each interval when the applications program 48*a* is used. It is noted that the total volume of the nodes for a respective geometry number remains constant.

Considering the third case where more fluid is moved during a tracking interval than the volume for which a segment has been defined, the present invention does not redefine the respective segment, but it performs a recursive operation so that all the needed parameters are still calculated at the given time. That is, at the time when the fluid parameter calculations are to be made, the parameters for the total volume of the fluid moved relative to the lesser volume segment are still calculated because the applications program retains the information that the volume of the segment plus an additional volume has been moved. This is also applicable to nodes corresponding to less than an entire segment.

In the preferred embodiment of the present invention, the recursive operation by which the parameters for the total volume are determined is included within a stacking routine which also performs the fluid tracking operations when flow does not exceed a node volume. In the latter case, the stacking routine is called with a pointer to the head node and processes the fluid information node by node. When a node volume is not exceeded, that node is processed for the new fluid and then the routine moves to the next node to process the old volume transferred from the prior node. Thus, every time a fluid is tracked into a node, a volume of fluid is tracked from that node into the next one.

Figure 9:
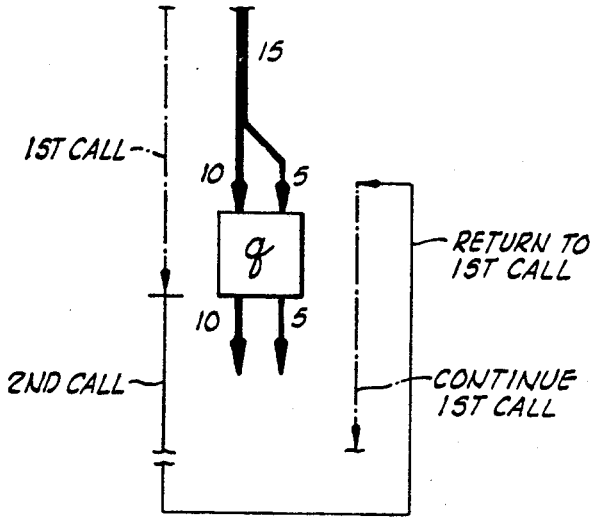
FIG. 9 is a block diagram illustrating a recursion operation of the present invention.

In the case of actual fluid flow volume exceeding the volume of a node (the "exceeded node"), the stacking routine processes the node for its maximum volume and then the stacking routine is again called (the recursion) but beginning with the full volume of fluid tracked out of the exceeded node and with the address of the next node following the exceeded node. This second call of the stacking routine accounts for this transferred amount of fluid in the normal manner. When it is finished with this recursive call, the routine comes back to the first call of the stacking routine and accounts for the balance of the actually pumped fluid (i.e., the difference between the actual volume pumped and the volume of the exceeded node). Assuming this balance is less than the volume of the exceeded node, the stacking routine proceeds in the normal manner through the remaining nodes. See FIG. 9 for an illustration of the foregoing process (node "q" has a maximum volume of 10 gallons, but the actual flow to be accounted for is 15 gallons; first, 10 gallons are tracked using a second call of the stacking routine beginning at the next node after q, and then return is made to node q in the first call of the stacking routine to process the remaining 5 gallons). If the balance exceeds the exceeded node, repeated calls are made as needed. Additional embedded calls of the stacking routine are made as needed in accounting for all of the fluid flow through the flow path illustrated in FIG. 1.

Although as was previously mentioned the equations for computing the various parameters and geometries listed in FIG. 6 are known, we have developed an improved definition for the equivalent straightened length of a curved section of the flow path. This is particularly relevant to, but not limited to, defining the true vertical depth (TVD) of a curved section of a deviated well. The equivalent height of a curved section has previously been approximated by simply assuming the curve extends for its length L straight from the vertical bore at an angle $\theta_1$. Thus, the equivalent height has been calculated as $\cos \theta_1 \times L$.

Figure 10:
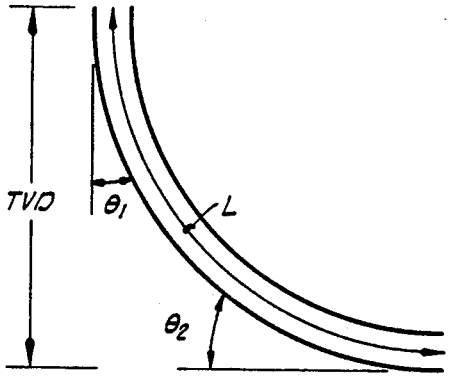
FIG. 10 is a schematic illustration of a curved segment of a flow path, which curved segment has geometrical characteristics as labeled in FIG. 10.

In actuality, the deviation is usually curved and not straight from the vertical reference. Such a curved portion deviates at its upper end from vertical by the same angle $\theta_1$, but it also deviates at its other end from a horizontal reference by an angle $\theta_2$. The curved length of the deviation is L. We then define a more precise TVD as $\sin |\theta_2-\theta_1|/|\theta_2-\theta_1| \times Pi/180 \times L/\cos(|\theta_2-\theta_1|/2) \times \sin (90-|\theta_2-\theta_1|/2-\theta_1)$. The geometry referred to is illustrated in FIG. 10. This improved definition of true vertical depth is particularly useful in calculating hydrostatic pressure with regards to the illustrated example of use in a well.

The appendices incorporated in this specification contain listings in source code, with explanatory comments, of three program modules by which the present invention is implemented. These would form part of the overall applications program 48*a*. These three modules are TUW_STACK.LIS (Appendix 1), TUW_UTILITIES.LIS (Appendix 2) and TUW_VACUUM.LIS (Appendix 3).

The module listed in Appendix 1 defines the initial nodes/segments based on the tubing and hole geometries (lines 9133–9411) and dynamically allocates new nodes (lines 9415–9535). This module also includes the stacking routine.

The stacking routine function referred to hereinabove starts at line 9539 of the listing in Appendix 1. The stacking routine function is the main module which is responsible for tracking the moving fluids. This routine is divided into three parts. The first is used when the well is on vacuum. In this case, the nodes are traversed in a slightly different manner than the normal traversal described above because the fluids are not adding to the hydrostatic head of the fluid column. The second and third sections of the stacking routine deal with real fluids. Part two (beginning at line 10190) checks to see if a new fluid is being pumped, and part three (beginning at line 10279) implements the movement of the real fluids around the well.

In part three of the stacking routine, which is the main section of the routine, various decisions are made. These include determining whether the fluids in adjacent nodes are the same type, determining whether the adjacent nodes are in different segments, determining whether the volume in is greater or less than the capacity for the receiving node, and whether gas is involved. The fluids are appropriately moved as described herein.

Recursive calls can be seen on line 9933, where the fluid is a vacuum fluid and its volume is greater than the next segment, and on lines 9982, 10044 and 10113 where vacuum fluids are again involved. On line 10470 a recursive call is used because gas expansion has changed the volume in to be greater than the volume out of a node.

The general recursive call described hereinabove comes on line 10550. This is a situation where a new fluid coming in contains no gas but its volume is greater than the node volume. The receiving "exceeded" node is called q and the fluid is coming from node p. Nodes p and q are in the same geometry. The stacking routine changes q's fluid to the new fluid and adds q's volume to p's volume (line 10522). Node q is then taken out of the list (line 10536), and q's volume is subtracted from the volume in (line 10541). The stacking routine is then again called with q's original fluid and volume and with a pointer to the node after q to account for the old fluid pumped from node q (lines 10549–10551). Upon return from this call (line 10552), the routine dynamically deallocates q from memory and then continues to pump the fluid through the rest of the well based on the balance of the actually pumped fluid which exceeded the volume of node q.

When no gas is being pumped into the well with the slurry or other liquid fluid, the stacking routine ignores the well head pressure that is measured and actually determines a calculated well head pressure. By using the calculated well head pressure, certain variables that can lead to erroneous results are omitted. These variables include poor transducer response at low pressure, pressure caused by turbulence at the well head that does not add to hydrostatic pressure, and varying horizontal and vertical distance of the transducer from the well head. The calculated well head pressure is also used as the indication of free fall for these same reasons.

The module TUW_UTILITIES.LIS (Appendix 2) is used to calculate friction pressure (lines 9119–9206), volume (lines 253–9262), deviation in degrees per foot (lines 9267–9282), length (9287–9325), pressure and temperature at leading edge of a segment (lines 9330–9459), bottom deviation (lines 9464–9497), flow rate in (lines 9502–9512), and the leading edge (lines 9516–9595).

The module TUW_UTILITIES.LIS is also used for calculating true vertical depth. This is done by the vertical height function at lines 9210–9249 in Appendix 2. If it has been determined that the well is deviated enough to require TVD geometry, this embodiment of the program shows that first an average angle in radians (line 9242) and then a radius are calculated (line 9245). In this calculation the length above is the tubing/casing length. TVD is then calculated as the radius times the sine of the average angle. A more preferred equation which can be substituted for finding TVD is $\sin |\theta_2-\theta_1|/|\theta_2-\theta_1| \times Pi/180 \times L/\cos(|\theta_2-\theta_1|/2) \times \sin (90-|\theta_2-\theta_1|/2-\theta_1)$, where $\theta_1$ is the upper deviation in radians and $\theta_2$ is the lower deviation in radians as illustrated in FIG. 10.

Although TVD for the most part is calculated through the utilities module, TVD calculations are also made in the vacuum module, TUW_VACUUM.LIS (Appendix 3) These calculations are performed in the check-on-fillup function (see lines 9493–9511 of Appendix 3) and in the vacuum calculations function (see lines 9674–9686 of Appendix 3). In both of these cases a back calcuation of the length of an arc given a required TVD is made. This is done when it is determined that the deviation at the top and bottom of the node are not the same whereupon an "else" loop is entered. "Theta" is computed in radians by adding the top and bottom deviations of the node. The radius of this curve is then calculated as TVD divided by the sine of theta (lines 9496 and 9678). X and Y coordinates of the partial curve are then solved for using this calculated radius in the equation for a circle (lines 9502–9505 and 9680–9683). Substitution is made and a quadratic equation is used. Using these coordinates, the bottom deviation is calculated (lines 9510 and 9685) and the length of the arc determined (lines 9511 and 9686).

The module of Appendix 3 is also used for making calculations to determine the amount of vacuum required to flow into a well to obtain pressure balance (lines 9583–9734 of Appendix 3). In general, on the first pass through this function, the TVD of the well is determined and stored in static memory (lines 9600–9608). The linked list is then parsed to determine the critical nodes within the flow path (lines 9615–9631). The equivalent geometries of these segments ("pipe factors") are then found as the ratio of a node's capacity to that of the last node in the tubing (lines 9634–9641). The equivalent densities inside the tubing ("pipe") and outside the tubing are then determined (lines 9641–9647). Equivalent density here means that if the annulus or casing were filled with one fluid, what would the density of that fluid be to obtain the same pressure conditions. The pipe factors and equivalent densities are then used in an equation to determine the vertical length of fluid that must be circulated from the bottom of the tubing (lines 9650–9653). If this particular node is deviated, the true vertical depth calculations previously mentioned are used to put the vertical length of fluid that was just calculated into a curved length. The subsequent portion of the vacuum calcluations section calculates the vacuum in at the top of the tubing to achieve the desired fluid movement at the bottom (lines 9661–9734).

The following summarizes the major aspects of the present invention.

Due to the dynamics of fluid movement, a doubly linked list is used to represent the fluid flow path. Each element, referred to as a node, in the original list is allocated as a function of changes in a fluid path geometry. Also, initial nodes can be allocated to constrain maximum volumes or links or they can be allocated as a marker for a particular point of interest in the flow path. Additional nodes can be allocated as needed during the actual fluid flow.

Each node is defined in a computer by a set of data describing physical attributes of the respective portion of a segment of the flow path to which the node pertains and associating it with a fluid contained in the respective portion of the segment, which fluid is further defined in a table of fluids entered in the computer.

In the preferred embodiment, flow through the segments is based on mass balance That is, if a certain amount of fluid enters a segment, the same amount of fluid must leave the segment, taking into account compression and expansion of the fluids. In order to manage the actual displacement of a large volume of a new fluid through a segment having a smaller volume, the method using the doubly linked nodes recursively calls itself until the larger volume of fluid has been accounted for.

Changes in volume and flow rate due to gas expansion and compression are handled by noting that the time between passes is very small (e.g., one second in the preferred embodiment); therefore, changes in pressure, rate and volume with respect to this tracking interval are also very small.

Free fall is determined using pressure conditions at the end of the flow path rather than at the beginning. Measured pressure conditions at the beginning of the fluid path are not used because of the difficulty in modeling the turbulence there. The calculated pressure at the end of the fluid path can also be used to find the pressure at any point along the flow path.

When free fall occurs, free fall volumes are determined by examining the major segments involved in free fall and transforming these segments into pseudo segments that contain a pseudo fluid of equivalent densities. The difference in hydrostatic head in these pseudo segments can then be used to determine the amount of pseudo fluid that must be circulated to bring the well into pressure equilibrium. This pseudo fluid volume is then put in terms of real fluid thereby giving the amount of real fluid that must be circulated to obtain pressure balance.

Within the calculations, an improved true vertical depth of a deviated fluid path section is defined by considering both top and bottom deviations from vertical and horizontal, respectively, and a radius based on these deviations and the length of the fluid path section.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of tracking fluids flowing along a flow path, comprising the steps of:

(a) selecting a plurality of sets of data to define initial segments of the flow path, including defining a geometry for each segment;

(b) identifying any previously placed fluid within the flow path and identifying and additional fluid to be moved into the flow path;

(c) moving previously placed fluid and additional fluid along the flow path at a known rate of movement; and (d) at selected times while the fluids move along the flow path, dynamically allocating additional sets of data as subsegments of the initial segments of the flow path so that each subsegment contains only one of the fluids and calculating parameters of the fluid within each subsegment based on the defined geometry and identified fluids of said steps (a) and (b).

2. A method as defined in claim 1, wherein said step (d) further includes calculating, at the later of the two consecutive ones of the selected times, parameters for the total volume of one of the fluids moved relative to one of the segments during the time between the two consecutive selected times, which total volume exceeds the volume of the respective segment.

3. A method as defined in claim 1, wherein the flow path includes a curved section having a length L and having two ends curving from respective references at angles $\theta_1$ and $\theta_2$, respectively, and further wherein defining a geometry of said step (a) includes defining for the curved section a straightened length defined by $$[\sin|\theta_2-\theta_1|/|\theta_2-\theta_1|\times Pi/180\times L/\cos(|\theta_2-\theta_1|/2)\times\sin(90-|\theta_2-\theta_1|/2-\theta_1)][(\sin|\theta_2-\theta_1|)/|\theta_2-\theta_1|]\times(Pi/180)\times[L/\cos(|\theta_2-\theta_1|/2)]\times\sin[90-(|\theta_2-\theta_1|/2)-\theta_1].$$

4. A method of tracking fluids flowing along a flow path comprising the steps of:

(a) selecting a plurality of sets of data to define initial segments of the flow path, including defining a geometry for each segment;

(b) identifying any previously placed fluid within the flow path and identifying any additional fluid to be moved into the flow path;

(c) moving previously placed fluid and additional fluid along the flow path at a known rate of movement so that during a predetermined time period fluid moves through at least one of the segments in greater volume that the segment is defined for in the respective set of data for the segment; and (d) at the end of the predetermined time periods, sequentially calculating by recursion parameters for the total volume of fluid moved relative to the segment during the predetermined time period.

5. A method as defined in claim 4, wherein the flow path includes a curved section having a length L and having two ends curving from respective references at angles $\theta_1$ and $\theta_2$, respectively, and further wherein defining a geometry of said step (a) includes defining for the curved section a straightened length defined by $[\sin|\theta_2-\theta_1|/|\theta_2-\theta_1|\times Pi/180\times L/\cos(|\theta_2-\theta_1|/2)\times\sin(90-|\theta_2-\theta_1)][(\sin|\theta_2-\theta_1|)/|\theta_2-\theta_1|]\times(Pi/180)\times[L/\cos(|\theta_2-\theta_1|/2)]\times\sin[90-(|\theta_2-\theta_1|/2)-\theta_1]$.

6. A method of tracking fluids flowing along a flow path including a curved section having a length L and two ends curving from respective references at angles $\theta_1$ and $\theta_2$, respectively, said method comprising the steps of:

(a) selecting a plurality of segments to characterize the flow path, including defining a geometry for each segment wherein for the curved section the geometry includes a straightened length defined in response to the length L and both angles $\theta_1$ and $\theta_2$;

(b) identifying any previously placed fluid within the flow path and identifying any additional fluid to be moved into the flow path;

(c) moving previously placed fluid and additional fluid along the flow path at a known rate of movement; and (d) at selected times while the fluids move along the flow path, calculating parameters of the fluids based on the defined geometries and the identified fluids.

7. A method as defined in claim 6, wherein the straightened length is defined by $[\sin|\theta_2-\theta_1|/|\theta_2-\theta_1|\times Pi/180\times L/\cos(|\theta_2-\theta_1|/2)\times\sin(90-|\theta_2-\theta_1|/2-\theta_1)][(\sin|\theta_2-\theta_1|)/|\theta_2-\theta_1|]\times(Pi/180)\times[L/\cos(|\theta_2-\theta_1|/2)]\times\sin[90-(|\theta_2-\theta_1|/2)-\theta_1]$.

8. A method of tracking fluids in a well in which a tubing is located and in which an annulus is defined outside the tubing, said method comprising the steps of:

defining the tubing and the annulus as a series of contiguous segments wherein each segment has a known geometry;

entering into a computer in doubly linked format respective sets of data defining nodes corresponding to the segments, including the known geometries thereof, so that within the computer the set of data for each node is doubly linked to the respective sets of data for any node contiguous thereto;

entering within the computer data about previous fluids already in the well and about added fluids to be added into the well;

entering identifying fluid data into the respective sets of data for the nodes within the computer corresponding to segments of the tubing and annulus in which there is a previous fluid;

pumping an added fluid into the well at a known flow rate so that previous fluid and added fluid move within the tubing and annulus;

creating within the computer, at a selected time while pumping occurs and in response to the known flow rate, additional sets of data corresponding to geometries of the originally defined nodes, wherein each new node and any remaining original node corresponds to a respective portion of the tubing and annulus having only one type of fluid in it at the selected time and further wherein the additional sets of data are doubly linked to sets of data for contiguous nodes; and calculating within the computer, at the selected time and for each set of data, parameters of the respective fluids based on the known geometries and the entered data about the fluids.

9. A method as defined in claim 8, wherein fluid is pumped so that during a predetermined time period ending at the selected time fluid moves through at least one of the segments in greater volume than the volume of the segment; and said step of calculating includes sequentially computing by recursion, at the selected time, parameters for the total greater volume of fluid pumped relative to the segment during the predetermined time period.

10. A method as defined in claim 8, wherein the tubing includes a curved section having a length L and having two ends curving from vertical and horizontal, respectively, at angles $\theta_1$and $\theta_2$, respectively, and further wherein said step of entering into a computer data defining the segments includes entering for the curved section a vertical height defined by $[\sin|\theta_2-\theta_1|/|\theta_2-\theta_1|\times Pi/180\times L/\cos(|\theta_2-\theta_1|/2)\times\sin(90-|\theta_2-\theta_1|/2-\theta_1)][(\sin|\theta_2-\theta_1|)/|\theta_2-\theta_1|]\times(Pi/180)\times[L/\cos(|\theta_2-\theta_1|/2)]\times\sin[90-(|\theta_2-\theta_1|/2)-\theta_1]$.

11. A method of maintaining a well pressure balanced, which well includes a tubing and an annulus through which fluid flows, said method comprising the steps of:

flowing fluid through a selected one of the tubing and annulus into the other of the tubing and annulus so that there are three regions of flow, including: in the tubing, between the tubing and annulus, and in the annulus;

converting within a compute the actual geometries of the three regions into equivalent geometries;

computing within a computer equivalent densities of the fluid within the tubing and annulus;

calculating, using the equivalent geometries and densities, a needed fluid flow between the tubing and annulus to balance the well pressure;

determining the actual input flow for the actual geometries and densities; and adding vacuum into said selected one of the tubing and annulus at the calculated actual input flow.

* * * * *